US005855501A

United States Patent [19]

Kato et al.

[11] Patent Number: 5,855,501

[45] Date of Patent: Jan. 5, 1999

[54] CIRCULATING TOY ASSEMBLY

[75] Inventors: Yuji Kato; Satoshi Fukumura, both of Tokyo, Japan

[73] Assignee: Dah Yang Toy Industrial Co., Ltd, Tainan, Taiwan

[21] Appl. No.: 1,160

[22] Filed: Dec. 30, 1997

[51] Int. Cl.[6] ..... A63H 11/08; A63H 29/08

[52] U.S. Cl. ..... 446/171; 446/168

[58] Field of Search ..... 446/168, 171, 446/233, 234, 314, 409, 425, 457, 458, 169, 173, 289, 431, 437, 325

[56] References Cited

U.S. PATENT DOCUMENTS

| | | | |
|---|---|---|---|
| 1,478,350 | 6/1923 | Okel | 446/173 |
| 1,534,097 | 8/1925 | Wilhelm et al. | 446/173 |
| 3,108,810 | 10/1963 | Wiley, Jr. | 273/120 |
| 3,818,628 | 6/1974 | Ensmann et al. | 446/173 |
| 4,290,695 | 9/1981 | Matsomoto | 273/110 |
| 4,678,449 | 7/1987 | Udagawa | 446/136 |
| 4,708,685 | 11/1987 | Udagawa | 446/139 |
| 4,728,312 | 3/1988 | Ohnuma | 446/171 |
| 4,778,430 | 10/1988 | Goldfarb et al. | 446/167 |
| 4,795,394 | 1/1989 | Thompson | 446/168 |
| 5,676,374 | 10/1997 | Bossa et al. | 273/237 |

*Primary Examiner*—Robert A. Hafer
*Assistant Examiner*—Michael B. Priddy
*Attorney, Agent, or Firm*—Darby & Darby

[57] ABSTRACT

A circulating toy assembly has a toy piece that circulates through an elevator and an inclining track member. A swing lever is mounted between a platform provided at the top of the elevator and an entrance end of the track member for conveying the toy piece from the platform to the entrance end. The swing lever swings in a plane which is inclined downward from the platform to the entrance end. The swing lever has a toy piece receiving bucket at one end and a counterweight at another end. When the bucket receives the toy piece from the platform the bucket turns downward and toward the entrance end by gravity to deliver the toy piece to the entrance end. When the bucket is empty, the counterweight causes the swing lever to turn so that the bucket turns to the platform. The toy piece preferably has an elongated hollow body which receives a ball to roll freely therein, thereby causing the toy piece to somersault along the track member. A gate is provided adjacent to the platform to control the forward movement of the toy piece from the platform.

7 Claims, 9 Drawing Sheets

CIRCULATING TOY ASSEMBLY

BACKGROUND OF THE INVENTION

1. Field of the Invention

This invention relates to a toy assembly, particularly to a circulating toy assembly which includes toy pieces that circulate via alternating upward and downward movement through an elevating mechanism and an inclined track.

2. Brief Description of the Related Prior Art

The prior art has suggested various toy assemblies which have circulating figured toy pieces that can circulate by alternatingly moving upward through elevating mechanisms and downward through downward inclined tracks. Some toy pieces are provided with slide rolls at their bottom sides to ease sliding movement along the tracks. Some elevating mechanisms have upward sliding plates to move the toy pieces from a lower place to a higher place. Some elevating mechanisms employ parallel toothed rocking plates to move the toy pieces upward step by step. Other elevating mechanisms use magnets to move the toy pieces by magnetic attraction. Although a variety of toy moving mechanisms are available in the art, further development is still desirable therefor in order to update their configurations and designs so as to present more appeal and amusement to children.

SUMMARY OF THE INVENTION

An object of the present invention is to provide a circulating toy assembly with a novel moving mechanism to carry toy pieces from one place to another.

Another object of the present invention is to prove a circulating toy assembly with toy pieces capable of somersaulting along a track member.

According to the present invention, a circulating toy assembly comprises: a toy piece having an elongated hollow body which has two opposing rounded ends, and a ball provided in the elongated hollow body for freely rolling therein between the rounded ends; an elevator including a support body with a bottom end and a top platform, and an elevating mechanism mounted to the support body to move the toy piece from the bottom end to the top platform along the support body; and a track member having an exit end connected to the bottom end, and an entrance end, wherein the track member inclines downward from the entrance end to the exit end to permit the toy piece to move by gravity from the entrance end to the exit end, and the entrance end is spaced from and lower than the platform. A swinging conveyor is provided between the platform and the entrance end to convey the toy piece from the platform to the entrance end. The swinging conveyor includes a swing lever which has one end for turning toward the platform and the entrance end alternatingly so as to repeatedly carry the toy piece from the platform and deliver the same to the entrance end. The end of the swing lever has a toy piece receiving bucket. The swinging conveyor further has an inclined support shaft to hold the swing lever in a plane which is inclined downward from the platform to the entrance end, thereby causing the toy piece receiving bucket of the swing lever to turn downward and toward the entrance end by gravity whenever it receives the toy piece from the platform. The swing lever further has a counterweight provided at another end opposite to the toy piece receiving bucket for turning downward and toward the entrance end by gravity whenever the toy piece is delivered from the toy piece receiving bucket to the entrance end. A gate is provided adjacent to the platform to control the forward movement of the toy piece from the platform to the swing lever.

BRIEF DESCRIPTION OF THE DRAWINGS

Other features and advantages of the present invention will become apparent in the following detailed description of the preferred embodiment with reference to the accompanying drawings, of which.

BRIEF DESCRIPTION OF THE PREFERRED EMBODIMENT

Figure 1:
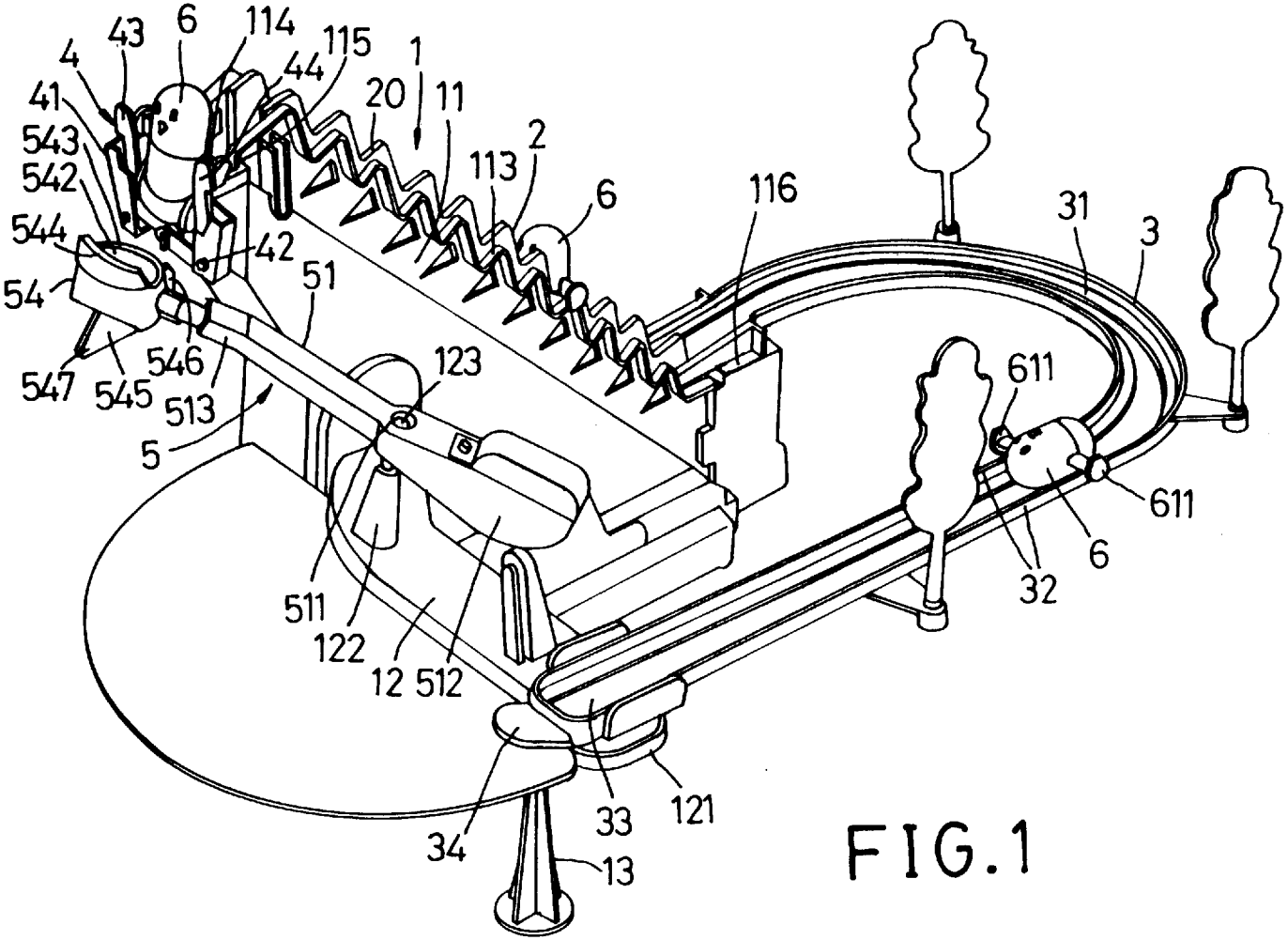
FIG. 1 is a perspective view of a preferred embodiment of the circulating toy assembly according to the present invention.
Figure 2:
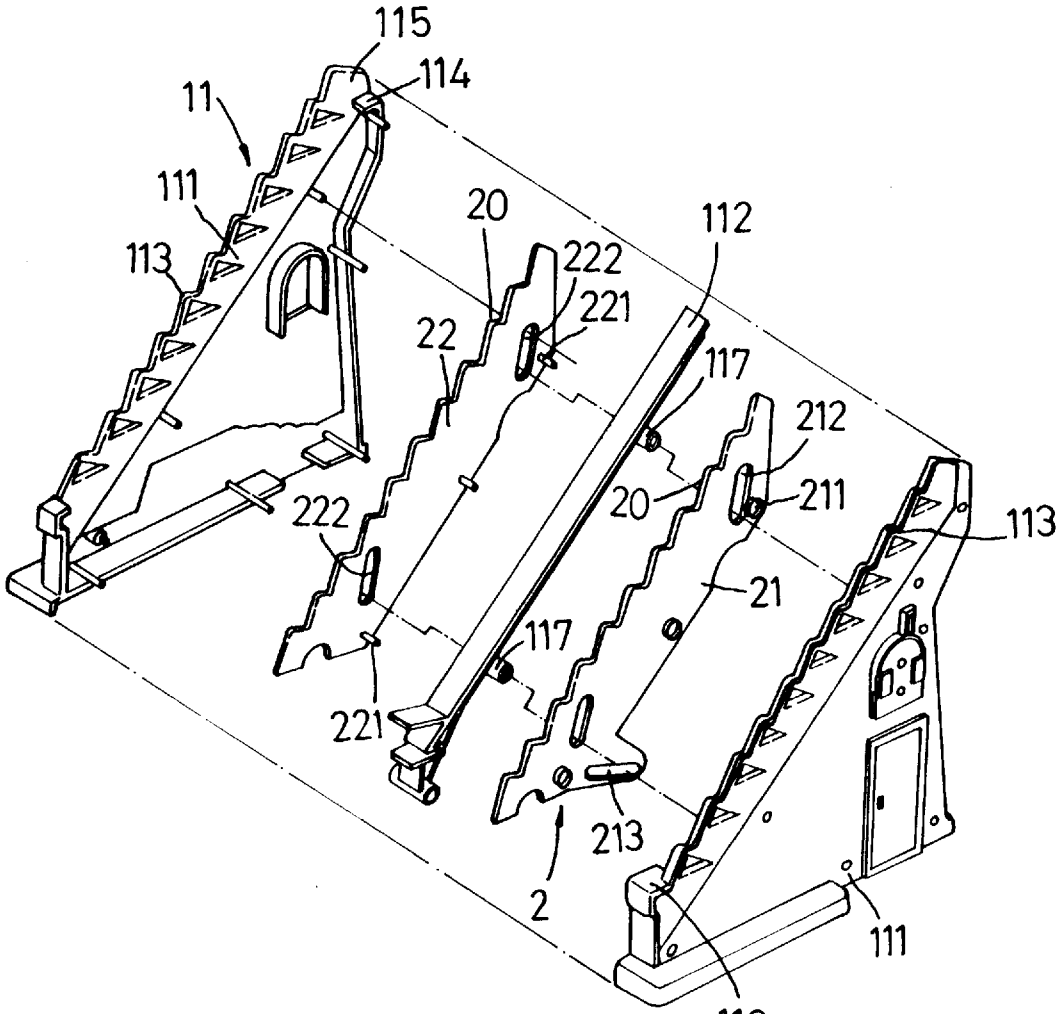
FIG. 2 is an exploded view of a staircase employed in the preferred embodiment.

Referring to FIGS. 1 and 2, a preferred embodiment of the present invention is shown to comprise an elevator 1, an elevating mechanism 2, a track member 3, a gate 4, a swinging conveyor 5 and a plurality of toy pieces 6.

The elevator 1 has a support body formed as a staircase 11 which includes a pair of vertically extending shell plates 111, and a middle inclined plate 112 disposed between the shell plates 111. Each shell plate 111 is stepped at its top end to form a series of stair steps 113, and is further provided with a top platform 114, a top mounting part 115 and a bottom end 116. The middle inclined plate 112 is provided with two protrusions 117 at one side thereof. An extension support plate 12 extends transversely from one side of the staircase 11 and has its distal end part 121 supported on a post 13. The extension support plate 12 extends horizontally at a height between the platform 114 and the bottom end 116 of the staircase 11. An inclined post 122 extends substantially upward from the extension support plate 12. An inclined support shaft 123 projects from the post 122.

Figure 3:
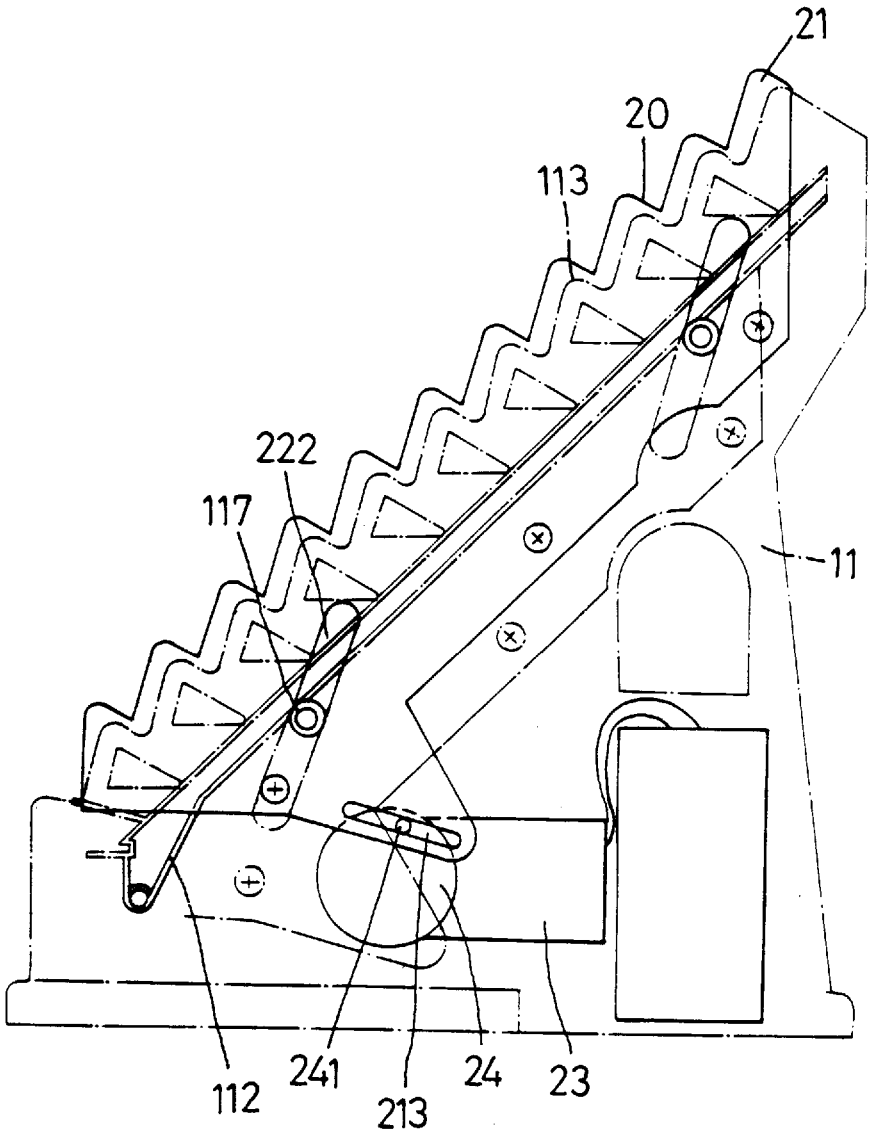
FIG. 3 shows an elevating mechanism associated with the staircase.

As shown in FIGS. 2 and 3, the elevating mechanism 2 comprises a main lifting plate 21 and an auxiliary lifting plate 22 provided at two sides of the middle inclined plate 112 between the shell plates 111. The lifting plates 21 and 22 are connected together by means of the mating plugs 221 and sockets 211. Guide holes 212, 222 are provided in the lifting plates 21 and 22, respectively, to receive the protrusions 117 of the middle inclined plate 112. The main lifting plate 21 is further provided with an elongated engaging hole 213. The top ends of the lifting plates 21, 22 are toothed to form a series of lifting faces 20. In order to drive the lifting plates 21, 22, a motor box 23 is provided inside the staircase 11 to hold a battery-operated motor (not shown) and a gear assembly (not shown) to rotate a wheel 24 which has an eccentric boss 241. The eccentric boss 241 extends into the engaging hole 213 of the main lifting plate 21 so that, when the wheel 24 is driven, the eccentric boss 241 rocks the main lifting plate 21. The main lifting plate 21 in turn moves the auxiliary lifting plate 22 synchronously due to the connection of the protrusions 117 with the guide holes 212, 222. Since the elevating mechanism is known, further details thereof will be omitted herein.

Figure 4:
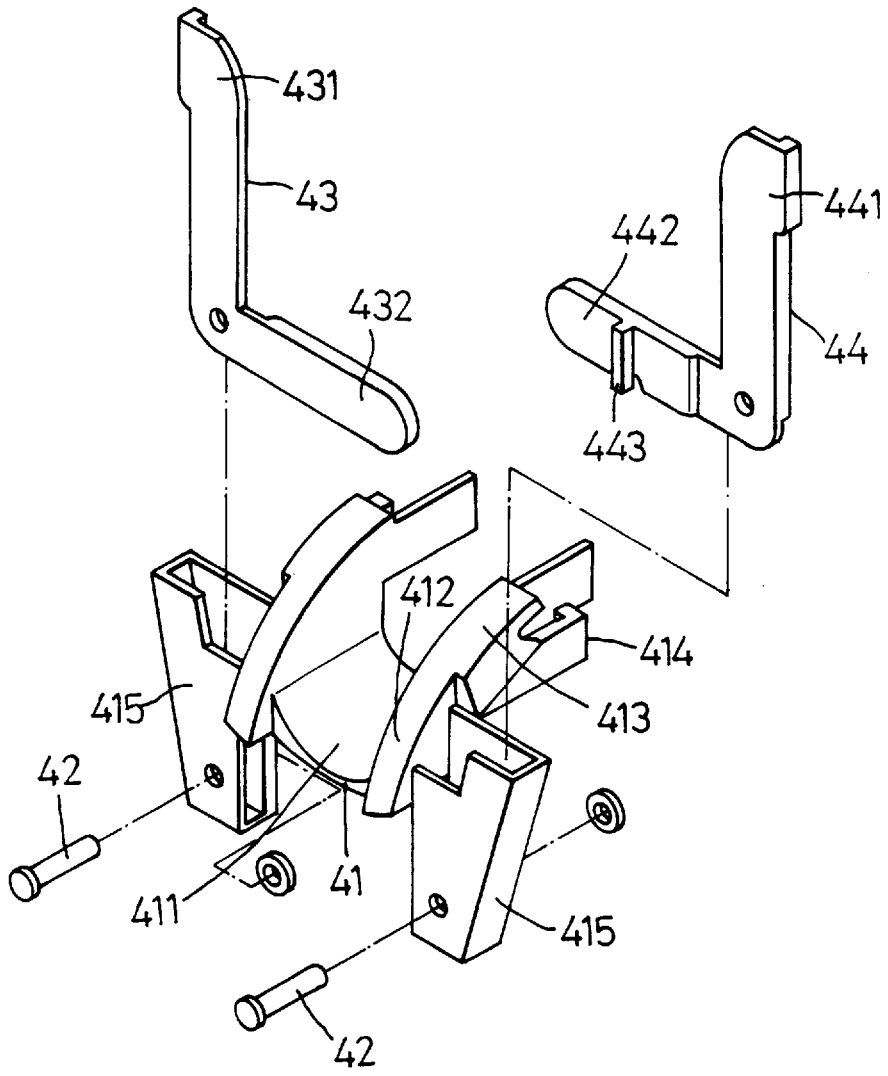
FIG. 4 is an exploded view showing a gate with gate members and a tilting seat employed in the embodiment.

Referring to FIG. 4, a curved track member 31 has one end mounted on the distal end part 121 of the extension support plate 12 and another end mounted to the bottom end 116 of the staircase 11. The track member 31 is provided with two opposing track walls 32 along the full length thereof. A push tongue plate 34 projects from an entrance end 33 of the track member 31.

As shown in FIGS. 1 and 4, the gate 4 is disposed adjacent to the platform 114 of the staircase 11 and includes two spaced apart gate members 43 and 44 which are pivoted respectively to two sides of a tilting seat 41. The tilting seat 41 is connected to the platform 114 and includes a tilting foot portion 411, which inclines downward from the platform 114. The tilting seat 41 further has two flanks 412 extending upward from two sides of the tilting foot portion 411, two flanges 413 projecting outwardly from the flanks 412, respectively, two anchor members 414 extending respectively from the flanges 413 to engage the mounting parts 115 of the shell plates 111, and two receiving members 415 connected respectively to the flanks 412. The gate members 43,44 are respectively received in and pivotally connected to the receiving members 415 for turning between an open position and a closing position. Each of the gate members 43, 44 has a generally L-shape and includes an upright stop portion 431 (441), and a transverse extension 432 (442). A protrusion 443 is formed on the transverse extension 442 of the gate member 44. Normally, the transverse extensions 432, 442 extend substantially horizontal below the tilting foot portion 411, and the upright stop portions 431, 441 are closely adjacent to the outer sides of the flanks 412 so that they are in the closing position to prevent the toy piece 6 from moving forward. When the upright stop portions 431, 441 turn outwardly from the flanks 412, the gate members 43, 44 are in their open position and thus permit the toy piece 6 to move forward.

Figure 5:
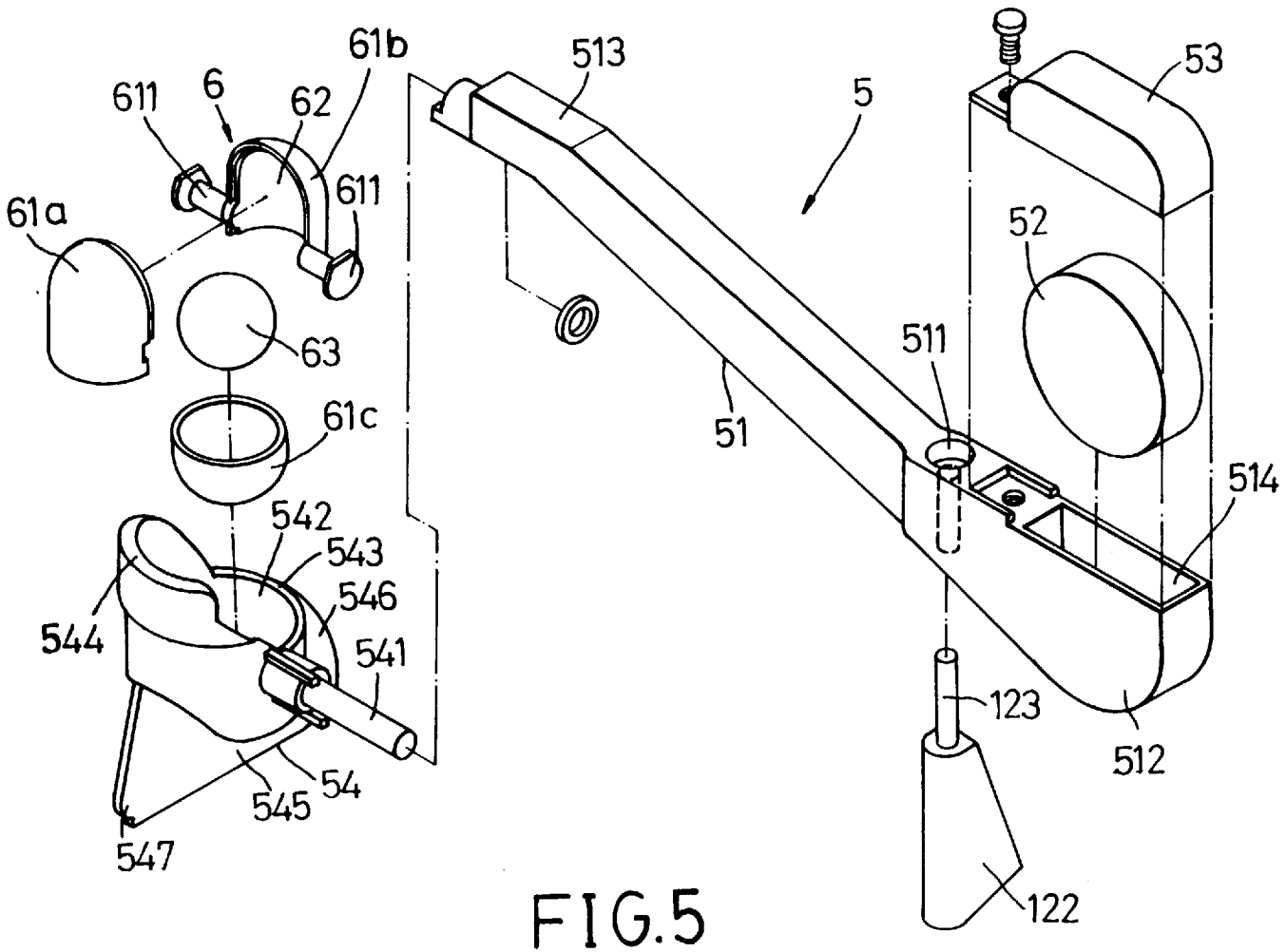
FIG. 5 is an exploded view of the swing lever conveyor employed in the embodiment.

Referring to FIG. 5 in combination with FIG. 1, the swinging conveyer 5 is provided between the gate 4 and the entrance end 33 of the track member 3 which is spaced from and lower than the gate 4. The swinging conveyor 5 comprises a swing lever 51 which is mounted pivotally to the inclined support shaft 123 that is provided on the extension support plate 12. The swing lever 51 has a pivot hole 511 to mount the swing lever 51 on the inclined support shaft 123 so that the swing lever 51 lies in a plane which is inclined downward from the gate 4 to the entrance end 33 of the track member 3. One end 512 of the lever 51 is provided with a recess 514 to receive a counterweight 52 and a cover 53 to cover the recess 514. Another end 513 of the lever 51 is provided with a toy piece receiving bucket 54 which is rotatably mounted to the end 513 via a shaft 541. The toy piece receiving bucket 54 has a cavity 542 with a top open end, a low front cavity wall 543 and a high rear cavity wall 544 which gradually rises from the front cavity wall 543. An actuating member 545 is formed at the bottom side of the toy piece receiving bucket 54 and has a gate actuating portion 546 to actuate the gate 4 and an opposite tab 547.

Each moving toy piece 6 can be moved upward along the staircase 1 via the elevating mechanism 2. Each toy piece 6 is constituted by three complementing shell parts 61*a*, 61*b*, 61*c* to form an elongated hollow body 62 with two opposite rounded ends. A ball 63 is received in the elongated hollow body 62 to freely roll between the opposite rounded ends. The toy piece 6 further has two outwardly stretching arms 611 for straddling on the lifting faces 20 of the main and auxiliary lift plates 21, 22, or on the stair steps 113 of the shell plates 111 so that, when the lift plates 21, 22 move, the toy piece 6 can be lifted thereby step by step along the staircase 11. The arms 611 can also straddle on the track walls 32 of the track member 3 when the toy piece 6 moves along the track member 3.

Figure 6:
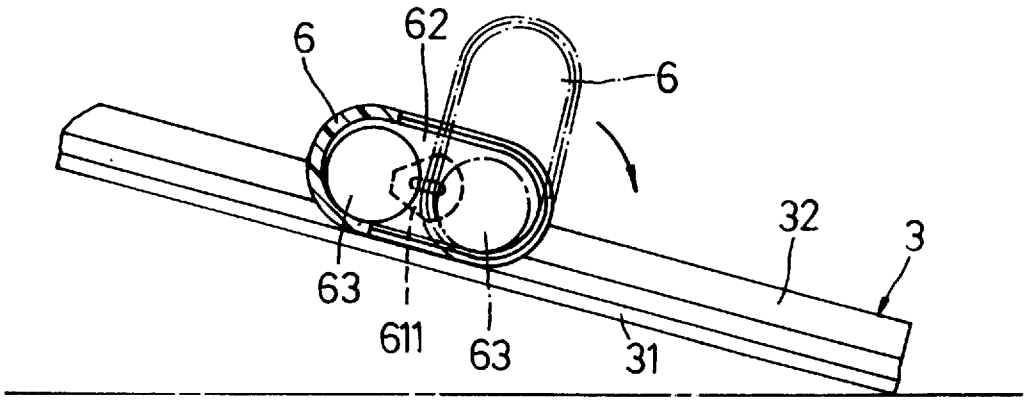
FIG. 6 shows how a toy piece somersaults along a track member.

As shown in FIGS. 1 and 6, when the toy piece 6 is delivered to the track member 3 from the toy piece receiving bucket 54, since the track member 3 is inclined downward from its entrance end 33 to the exit end adjacent to the bottom end 116 of the staircase 11 and since the ball 63 provided inside the toy piece 6 constantly rolls forward in a downward direction, the toy piece 6 can turn upward and then downward when the ball 63 rolls forward constantly inside the elongated hollow body 62 of the toy piece 6. As a result, the toy piece 6 turns alternatingly to a lying position and an upstanding position, thereby resulting in successive somersault turns while moving from the entrance end 33 of the track member 3 to the bottom end 116 of the staircase 11. When reaching the staircase 11, the toy piece 6 is moved by the elevating mechanism 2 to the top platform 114.

Figure 7:
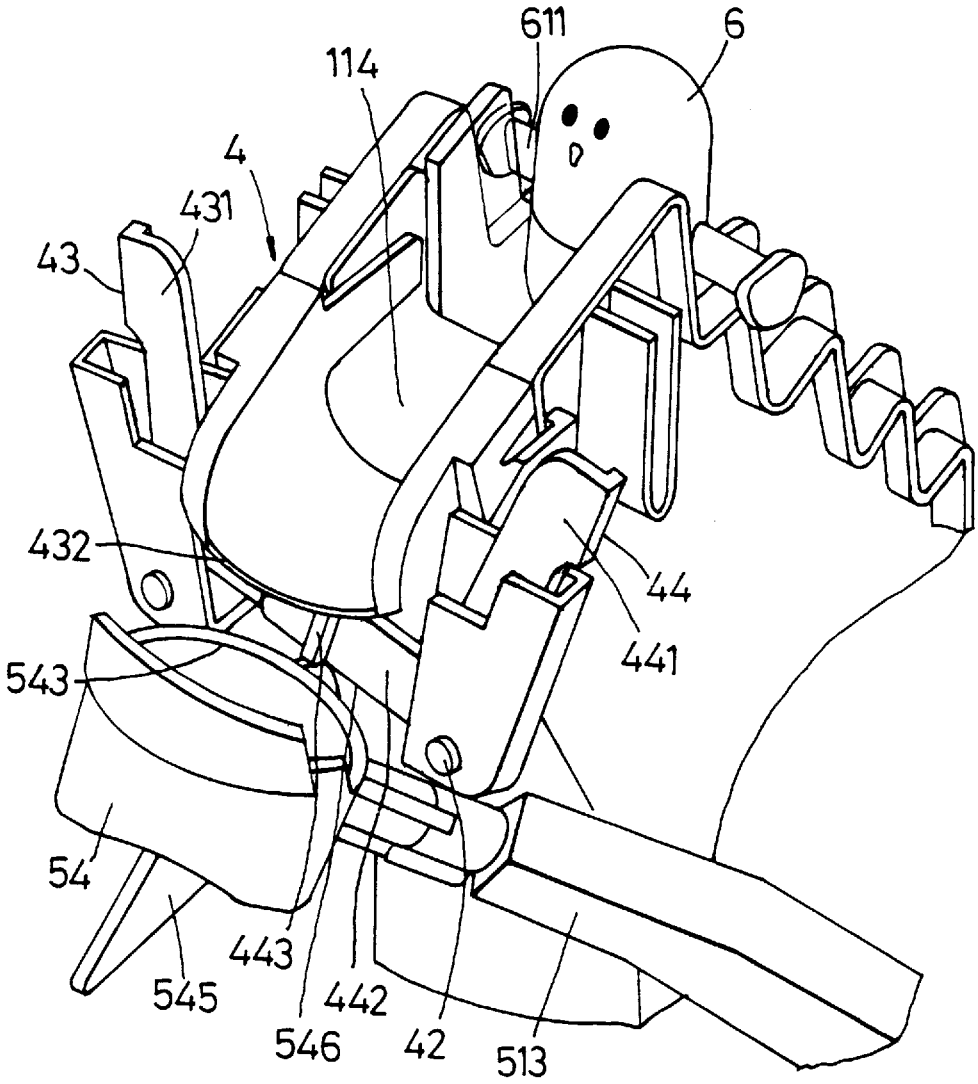
FIG. 7 is a perspective view showing the toy piece as it climbs toward the platform of the staircase.

Referring to FIG. 7 in combination with FIG. 1, when the toy piece receiving bucket 54 is empty, the end 513 of the lever 51 is turned upward to the gate 4 because the end 512 with the counterweight 52 of the swing lever 51 is turned downward and toward the track member 3 by gravity. As the bucket 54 contacts against the gate 4, the gate actuating portion 546 of the toy piece receiving bucket 54 pushes upward the transverse extensions 432, 442 of the gate members 43, 44 so that the upright stop portions 431, 441 turn outward, thereby placing the gate 4 in the open position. In this situation, the low front cavity wall 543 of the toy piece receiving bucket 54 abuts against the protrusion 443 of the gate member 44.

Figure 8:
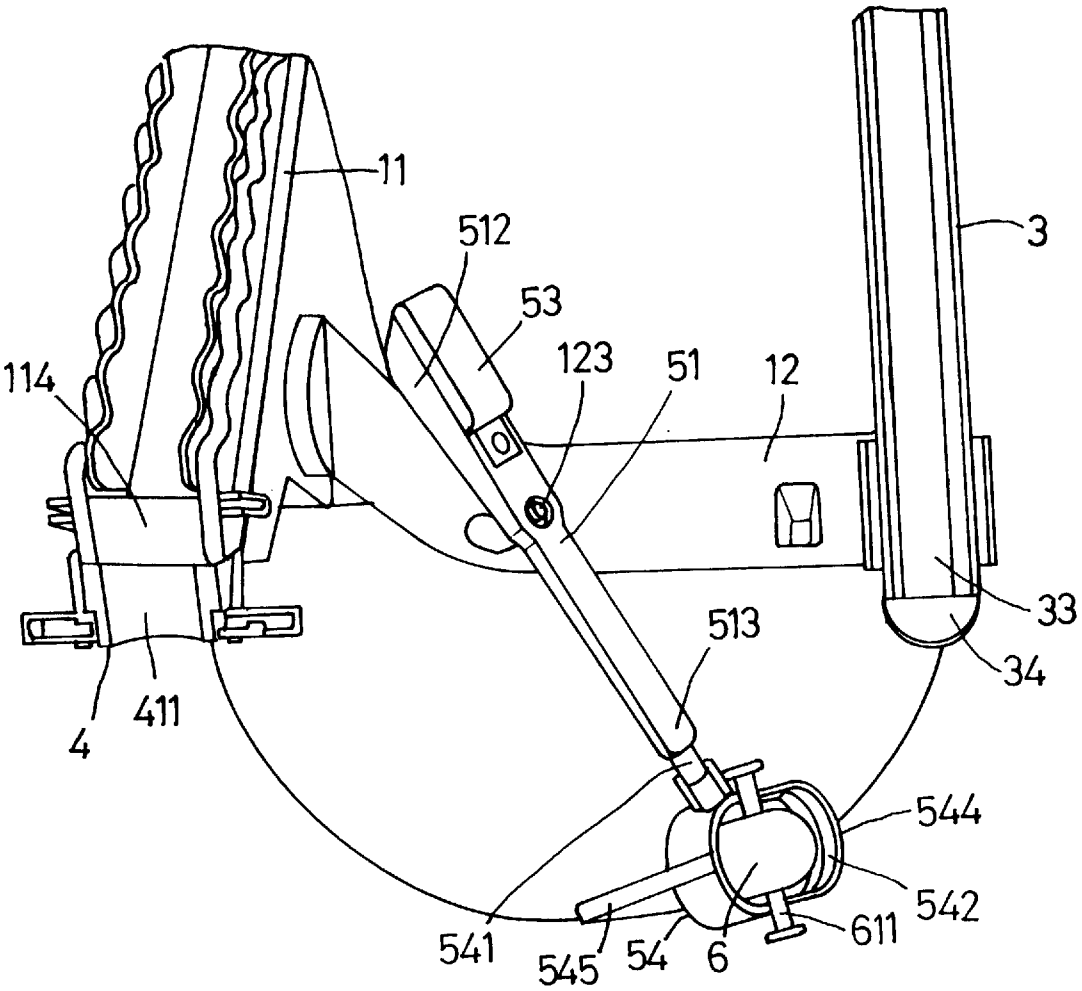
FIG. 8 is a top view showing the swing lever as it carries the toy piece to the entrance end of the track member.

Referring to FIGS. 1 and 8, when the toy piece 6 reaches the platform 114, since the tilting foot portion 411 is inclined downward, the moving toy piece 6 loses its balance and tilts so that it falls into the toy piece receiving bucket 54. As the bucket 54 receives the toy piece 6, the end 513 of the swing lever 51 is turned downward and toward the entrance end 33 of the track member 3 due to the torque resulting from the weight of the toy piece 6. When the tab 547 of the actuating member 545 strikes the push tongue 34 of the entrance end 33 of the track member 3, the upwardly inclining push tongue 34 pushes the tab 547 so that the bucket 54 turns about the pivot shaft 541 and the open end of the cavity 542 of the bucket 54 is directed toward the track member 3, thereby delivering the toy piece 6 onto the track member 3.

Figure 9:
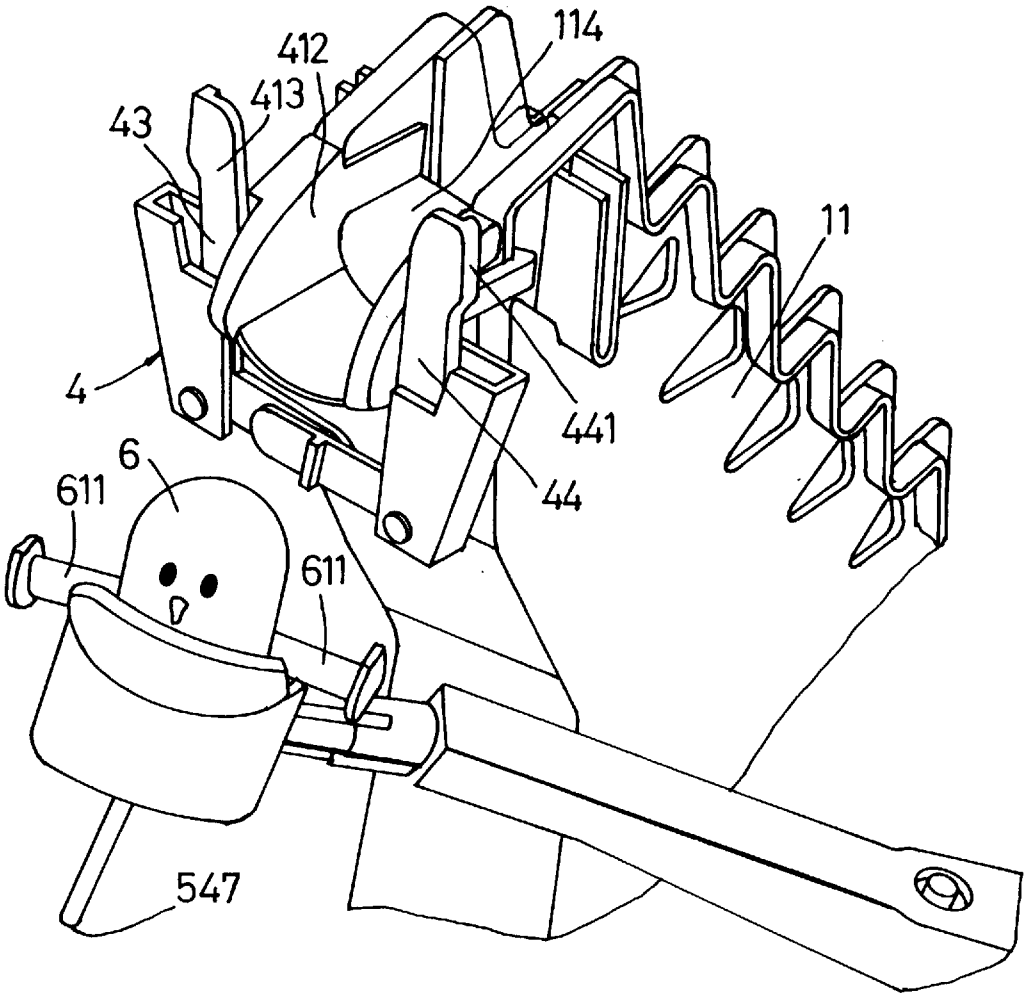
FIG. 9 is a perspective view showing the gate members returning to their normal positions after a toy piece receiving bucket leaves the gate.

As shown in FIG. 9, after the bucket 54 leaves the gate 4, the gate members 43, 44 return to their normal positions due to the returning downward movement of the transverse extensions 432, 442. Since the distance between the gate members 43, 44 is smaller than the total width of the toy piece 6 measured from one arm 611 to the other arm 611, the toy piece 6 can be stopped by the gate members 43, 44 until the toy piece receiving bucket 54 of the swing lever 51 turns back to the gate 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A circulating toy assembly comprising:

a toy piece having an elongated hollow body which includes two opposing rounded ends, and a ball provided in said elongated hollow body for freely rolling therein said rounded ends;

an elevator including a support body with a bottom end and a top platform, and an elevating mechanism mounted to said support body to move said toy piece from said bottom end to said top platform along said support body;

a track member having an exit end connected to said bottom end, and an entrance end, said track member being inclined downward from said entrance end to said exit end to permit said toy piece to move by gravity from said entrance end to said exit end, said entrance end being spaced from and lower than said platform;

a swinging conveyor provided between said platform and said entrance end to convey said toy piece from said platform to said entrance end, said swinging conveyor including a swing lever which has one end for turning toward said platform and said entrance end alternatingly so as to carry said toy piece from said platform and to deliver said toy piece to said entrance end, said one end of said swing lever having a toy piece receiving bucket, said swinging conveyor further having an inclined support shaft to hold said swing lever in a plane which is inclined downward from said platform to said entrance end, thereby causing said one end of said swing lever to turn downward and toward said entrance end by gravity whenever said swing lever receives said toy piece from said platform, said swing lever further having a counterweight provided at another end opposite to said one end for turning downward and toward said entrance end by gravity whenever said toy piece is delivered from said toy piece receiving bucket to said entrance end; and a gate provided adjacent to said platform to control forward movement of said toy piece from said platform to said swing lever;

wherein said gate includes two gate members which are mounted moveably to said support body adjacent to said platform to move between a closing position for preventing said toy piece from moving forward and an open position for permitting said toy piece to move forward.

2. A circulating toy assembly comprising:

a toy piece having an elongated hollow body which includes two opposing rounded ends, and a ball provided in said elongated hollow body for freely rolling therein said rounded ends;

an elevator including a support body with a bottom end and a top platform, and an elevating mechanism mounted to said support body to move said toy piece from said bottom end to said top platform along said support body;

a track member having an exit end connected to said bottom end, and an entrance end, said track member being inclined downward from said entrance end to said exit end to permit said toy piece to move by gravity from said entrance end to said exit end, said entrance end being spaced from and lower than said platform;

a swinging conveyor provided between said platform and said entrance end to convey said toy piece from said platform to said entrance end, said swinging conveyor including a swing lever which has one end for turning toward said platform and said entrance end alternatingly so as to carry said toy piece from said platform and to deliver said toy piece to said entrance end, said one end of said swing lever having a toy piece receiving bucket, said swinging conveyor further having an inclined support shaft to hold said swing lever in a plane which is inclined downward from said platform to said entrance end, thereby causing said one end of said swing lever to turn downward and toward said entrance end by gravity whenever said swing lever receives said toy piece from said platform, said swing lever further having a counterweight provided at another end opposite to said one end for turning downward and toward said entrance end by gravity whenever said toy piece is delivered from said toy piece receiving bucket to said entrance end; and a gate provided adjacent to said platform to control forward movement of said toy piece from said platform to said swing lever;

wherein said support body further has an extension support plate that extends from one side of said support body transversely at a height between said platform and said bottom end, said inclined support shaft being mounted on said extension support plate.

3. The circulating toy assembly as claimed in claim 1, wherein said toy piece receiving bucket has an actuating member to actuate said gate member to move to said open position when said one end of said swing lever reaches said platform and said gate.

4. The circulating toy assembly as claimed in claim 3, wherein said gate further includes a tilting seat connected to said platform, said tilting seat being inclined downward from said platform so as to tilt and deliver said toy piece into said toy piece receiving bucket when said toy piece reaches said platform and when said gate members are in said open position, said gate members being pivotally connected to said tilting seat.

5. The circulating toy assembly as claimed in claim 4, wherein said gate members are substantially L-shaped and have upright stop portions extending upward at two sides of said tilting seat to stop said arms and forward movement of said toy piece in said closing position of said gate, and transverse extensions extending below said tilting seat from said upright stop portions, said gate members being pivoted to said tilting seat so as to cause said upright stop portions to turn outward to said open position when said transverse extensions are moved upward by said actuating member of said toy piece receiving bucket.

6. A circulating toy assembly comprising:

a toy piece having an elongated hollow body which includes two opposing rounded ends, and a ball provided in said elongated hollow body for freely rolling therein said rounded ends;

an elevator including a support body with a bottom end and a top platform, and an elevating mechanism mounted to said support body to move said toy piece from said bottom end to said top platform along said support body;

a track member having an exit end connected to said bottom end, and an entrance end, said track member being inclined downward from said entrance end to said exit end to permit said toy piece to move by gravity from said entrance end to said exit end, said entrance end being spaced from and lower than said platform;

a swinging conveyor provided between said platform and said entrance end to convey said toy piece from said platform to said entrance end, said swinging conveyor including a swing lever which has one end for turning toward said platform and said entrance end alternatingly so as to carry said toy piece from said platform and to deliver said toy piece to said entrance end, said one end of said swing lever having a toy piece receiving bucket, said swinging conveyor further having an inclined support shaft to hold said swing lever in a plane which is inclined downward from said platform to said entrance end, thereby causing said one end of said swing lever to turn downward and toward said entrance end by gravity whenever said swing lever receives said toy piece from said platform, said swing lever further having a counterweight provided at another end opposite to said one end for turning downward and toward said entrance end by gravity whenever said toy piece is delivered from said toy piece receiving bucket to said entrance end; and a gate provided adjacent to said platform to control forward movement of said toy piece from said platform to said swing lever;

wherein said another end of said swing lever has a recess and a cover to close said recess, said counterweight being provided in said recess.

7. The circulating toy assembly as claimed in claim 3, wherein said toy piece receiving bucket has an open end and is rotatably connected to said one end of said swing lever for turning said open end upward upon reaching said platform and downward upon reaching said entrance end, said actuating member being connected to said toy piece receiving bucket opposite to said open end, said actuating member having a gate actuating portion to actuate said gate and a tab extending in a direction opposite to said gate actuating portion, said entrance end being formed with a push tongue to push said tab so as to turn said toy piece receiving bucket.

* * * * *